US006554951B1

(12) United States Patent
Page et al.

(10) Patent No.: US 6,554,951 B1
(45) Date of Patent: Apr. 29, 2003

(54) CHEMICAL-MECHANICAL POLISHING PAD CONDITIONING SYSTEM AND METHOD

(75) Inventors: Cary R. Page, Dimebox, TX (US); John A. Kaiser, Austin, TX (US); Moses R. Saenz, Del Valle, TX (US)

(73) Assignee: Advanced Micro Devices, Inc., Sunnyvale, CA (US)

( * ) Notice: Subject to any disclaimer, the term of this patent is extended or adjusted under 35 U.S.C. 154(b) by 135 days.

(21) Appl. No.: 09/690,704

(22) Filed: Oct. 16, 2000

(51) Int. Cl.[7] ..... B24B 21/18
(52) U.S. Cl. ..... 156/345.12; 451/444
(58) Field of Search ..... 156/345.12; 451/444

(56) References Cited

U.S. PATENT DOCUMENTS 5,320,706 A 6/1994 Blackwell
5,667,433 A 9/1997 Mallon
5,683,289 A * 11/1997 Hempel, Jr. ..... 451/56
5,755,979 A 5/1998 Appel et al.
5,804,507 A * 9/1998 Perlov et al. ..... 438/692
5,851,138 A 12/1998 Hempel, Jr.
5,913,715 A 6/1999 Kirchner et al.
5,957,757 A 9/1999 Berman
5,985,093 A 11/1999 Chen
6,093,280 A 7/2000 Kirchner et al.
6,217,430 B1 * 4/2001 Koga et al. ..... 451/444

FOREIGN PATENT DOCUMENTS

JP 11-129153 * 5/1999

* cited by examiner

*Primary Examiner*—Gregory Mills
*Assistant Examiner*—Sylvia R. MacArthur
(74) *Attorney, Agent, or Firm*—Robert C. Kowert; Meyertons, Hood, Kivlin, Kowert & Goetzel, P.C.

(57) ABSTRACT

A chemical-mechanical polishing pad conditioning system and method. The system includes a conditioning device that may be used to condition a polishing pad. The system may also include a first conduit for introducing a chemical reagent onto the polishing pad, a second and third conduit for introducing the chemical reagent and a rinsing fluid respectively onto a conditioning surface of the.conditioning device or a storage apparatus of the conditioning device. The method includes introducing the chemical reagent onto the polishing pad during the pad conditioning process. The chemical reagent may further be introduced onto the storage apparatus or be introduced onto the conditioning surface of the conditioning device. The rinsing fluid may be introduced onto the polishing pad, the storage apparatus, or the conditioning surface.

20 Claims, 8 Drawing Sheets

CHEMICAL-MECHANICAL POLISHING PAD CONDITIONING SYSTEM AND METHOD

BACKGROUND OF THE INVENTION

1. Field of the Invention

This disclosure relates to integrated circuit fabrication, and more particularly to a system and method for conditioning a polishing pad used in a chemical-mechanical polishing process.

2. Description of the Related Art

Modern integrated circuits (ICs) employ advanced transistor isolation and multi-level interconnect techniques to increase both circuit functionality and processing speed. Conventional transistor isolation fabrication techniques utilizing LOCOS (LOcal Oxidation of Silicon) have been virtually superceded by STI (Shallow Trench Isolation) technology to overcome the "bird's beak" effect associated with LOCOS processing and allows for increased device packing densities. Multi-layer interconnects are pervasively used to facilitate interconnect routing between the transistors of the IC devices, also enabling increased packing densities. In addition, copper interconnects are being implemented in place of conventional aluminum interconnects, due to their improved conductivity and resistance to electromigration over aluminum, to reduce interconnect routing delays and thereby improve processing speed.

STI processing involves the formation of trenches recessed into a semiconductor substrate between adjacent active regions of the IC device. The trenches are then filled in with a dielectric material and subsequently planarized so that the uppermost surfaces of the dielectric and the substrate are approximately equal. Common dielectric materials include oxides, nitrides, or oxynitrides. Interconnect processing involves the formation of an interlevel dielectric between a lower level and an upper level. Contact areas, or vias, are then opened through the interlevel dielectric and subsequently filled in with a conductive material to electrically link the two levels together in the desired interconnect routing scheme. For metallization technologies using inlaid techniques, such as copper interconnects, the metal layers are also created by forming trenches into the interlevel dielectric and filling in the trenches with a conductive material. Additional levels of interconnects may be constructed in the same manner upon the prior levels to form a multi-level interconnect IC device. The interlevel dielectrics are frequently planarized prior to formation of the vias or trenches to minimize elevational disparity across the semiconductor substrate. This facilitates both photolithography of the vias and trenches and provides optimum step coverage of the conductive material being filled in. The conductive layers may also be planarized to form the final interconnect structures.

Modern IC devices simultaneously employ the use of STI and multi-level interconnect technologies to meet the demands for increased functionality and faster processing speeds. Accordingly, planarization of the interlevel dielectrics, conductive layers, and the trench dielectrics is required for optimum fabrication results. Planarization of these layers may be achieved through chemical-mechanical polishing (CMP) techniques, which has received widespread acceptance in the semiconductor processing industry. Generally speaking, CMP processes may be used to globally planarize and remove surface topography irregularities of a material layer(s) through chemical reaction and mechanical abrasion. A typical CMP process involves placing a semiconductor substrate face-down on a polishing pad which is attached to a rotatable table, or platen. An abrasive fluid, known as slurry, is introduced onto the surface of the rotating polishing pad and the substrate is then pressed against the polishing surface by a downward force. The substrate may also be rotated in conjunction with the rotating polishing pad. The chemical-mechanical interaction is provided by solution chemistry and abrasives contained in the slurry. Typical abrasives used by CMP processes include silica, alumina, and ceria. Other abrasives may be utilized and are often matched with the material layer(s) to be removed. Chemical interaction between the slurry and the material layer(s) being polished initiates the polishing process. The abrasives, coupled with the rotational movement of the polishing pad, physically strip the reacted surface material from the substrate. The process continues until the desired thickness amount of the material layer(s) is removed. Upon completion of the polishing process, the substrate is then subjected to a cleaning process to remove residual slurry and foreign particulates, including polish by-products, that may remain on the substrate surface.

By semiconductor fabrication standards, CMP is inherently a dirty process. The use of slurry to facilitate removal of the material layer introduces a significant amount of particles to the substrate surface, which must be removed in the subsequent cleaning step. In addition, during planarization by a CMP process, the substrate surface may be subjected to extremely high local mechanical pressures and exposed to either highly acidic or caustic solutions. Therefore, a substrate planarized by CMP may result in many unwanted defects on or within the upper surfaces. These defects may include, for example, residual particles from the slurry or the abraded substrate surface, chemical contamination from the slurry and/or other fluids, and physical surface damage such as microscratches or film fractures from the mechanical force being applied during polish. These defects have the potential to become yield-limiting defects, affecting die yields of the finished IC devices. For example, microscratches may scratch the surfaces of active regions thereby resulting in higher transistor leakage currents due to crystallographic damages. In addition, a microscratch formed in the surface of the dielectric layer may result in a residual conductive material being trapped into the divots formed by the microscratches during CMP, and potentially short out desired interconnect features. Moreover, residual surface particles may affect areas on the substrate where subsequent photolithography processes occur. The presence of the particles may prevent proper formation of the features defined by the photolithography process. As a result, efforts to substantially reduce the defects introduced by CMP have received considerable awareness.

Efforts to remove residual particles from the polish due to CMP processing have included scrubbing the substrate with brushes, spraying the substrate surface with a pressurized flow of cleaning liquids, and acoustically removing the particles through ultrasonic or megasonic cleaning techniques. Reduction of microscratches have examined minimizing the down force applied to the substrate onto the polishing pad, employing slurries with smaller abrasive grain sizes, and reducing the abrasiveness of the polishing pad. Varying degrees of effectiveness have been gained by these described methods.

Despite the above-described efforts, CMP-induced defects may still be formed and potentially impact final device yields. Considering that CMP processes account for an increasing portion of the entire IC fabrication process flow (STI, local interconnect, inlaid vias and metal), the compounding rate of defects introduced by CMP processes may significantly influence final yields of the IC devices. It would therefore be desirable to provide a method and system for minimizing defects associated with CMW processes. A reduction in defect density of CMP-induced defects may translate into increased die yields of the IC devices being fabricated.

SUMMARY OF THE INVENTION

The problems outlined above are in large part addressed by a CMP pad conditioning system and method in which a chemical reagent may be introduced onto the polishing pad during conditioning of the polishing pad. In addition, the chemical reagent may further be introduced onto a storage apparatus that may be used to store the conditioning device and may further be introduced onto the conditioning surface of the conditioning device which is in abrasive contact with the polishing pad during pad conditioning. Introduction of the chemical reagent may reduce the accumulation of previously used slurry (hereinafter "slurry buildup") and glaze present on the polishing pad, on the storage apparatus, and on the conditioning surface. The reduction in slurry buildup and glaze may minimize the formation of defects on the substrate being polished. These defects may include, for example, residual particles and microscratches. The reduction may also minimize reduced polishing rates and increased polishing non-uniformity. A rinsing fluid may also be introduced onto the polishing pad, the storage apparatus, and the conditioning surface to rinse away the accumulated glaze and slurry buildup.

Of the various performance parameters associated with CMP processing, there are two parameters which largely affect optimum CMP results. These parameters are polishing rate and polishing non-uniformity. Polishing rate, typically measured in units of angstroms/minute, is the rate at which the film thickness of the desired material layer is removed. Higher polish rates lead to shorten process times and are often desirable to reduce fabrication cycle times. However, higher polish rates result in increased process control difficulties. Polishing non-uniformity, typically given as a percentage, is the degree of non-planarity of the upper layer surface of the substrate upon completion of the CMP process. Ideal CMP processes exhibit 100% planarity and therefore, the non-uniformnity would be 0%. In reality, however, some degree of non-uniformity will be present and therefore minimizing the degree of polishing non-uniformity is desirable. Factors that may affect the polishing rate and polishing non-uniformity are numerous, and include, for example, slurry composition, applied down force, pad materials, pad rotational speed and slurry flow rate onto the polishing pad.

Polishing pads play an important role in optimum CMP performance. They provide mechanical abrasion for physically removing the material layer from the substrate surface. Polishing pad structure and material properties strongly influence polishing rate and polishing non-uniformity. In general, surface roughness and porosity of the polishing pad determine slurry transport to the substrate surface, material transport away from the substrate surface, and the contact area of the pad to the substrate surface. Therefore, maintaining optimum pad surface roughness and porosity over the useful life of the pad is essential to obtaining ideal polish results. In addition, extending the useful life of the pad is also desirable to minimize costs associated with CMP processes. By extending the pad life, pad changes may occur less frequently and thus reduce the cost of pad consumables. Unfortunately, polishing on the same polishing pad over an extended period induces an undesirable effect known as "pad glazing". Pad glazing results when polishing by-products along with the abrasives in the slurry accumulate on the upper surfaces of the polishing pad, forming a glaze. The glaze smoothes the upper surface of the polishing pad thereby reducing the abrasive properties of the polishing pad. As a result, a reduction in the polishing rate is experienced. In addition, the glazed layers are often unevenly distributed over a polishing pad surface, resulting in localized differences in polishing rates. This results in increased polishing non-uniformity.

In order to minimize the glazing effect, a technique known as pad conditioning may be used to maintain the surface roughness and porosity of the polishing pad. The technique involves mechanically abrading the pad surface in order to remove the glaze and "renew" the pad surface. Renewing the pad surface may be accomplished by a conditioning device with a conditioning surface. The conditioning surface may include an abrasive surface to provide the mechanical abrasion. During pad conditioning, the conditioning device is positioned over the polishing pad and a downward force may be applied such that the conditioning surface is in abrasive contact with the polishing pad surface. The conditioning device may sweep back and forth across the polishing pad, which may be continuously rotated, to facilitate removal of the glaze across the entire lateral surface of the polishing pad. The device may also move in a lateral direction from an inner portion to an outer portion of the polishing pad. A rinsing fluid may be continuously injected onto the pad to aid in removing the abraded glaze from the pad surface.

Unfortunately, the mechanical abrasion provided by the conditioning device may not be sufficient to remove the glaze or may fail to remove the glaze from various areas of the polishing pad. In addition, the slurry buildup that may be present on the polishing pad may also fail to be removed. In addition, the glaze and slurry buildup may also be transferred to the conditioning surface of the conditioning device and accumulate on that surface. Upon completion of pad conditioning, the conditioning device is typically positioned away from the polishing pad surface and returned to a storage position. The glaze and slurry buildup may also begin to accumulate on a storage apparatus that may be used to store the conditioning device at the storage position. In a subsequent pad conditioning process, the conditioning device moves from the storage position and is positioned over the polishing pad surface to begin pad conditioning as previously mentioned. The accumulated glaze and slurry buildup on the conditioning surface and/or the storage apparatus may then be transferred back onto the polishing pad. The transferred glaze and slurry buildup may then negatively form defects such as residual particles and microscratches during a CMP process. Prevention or minimization of accumulated glaze and slurry buildup on the polishing pad surface, the conditioning surface, and the storage apparatus is therefore desirable to minimize defect formation, reduced polishing rates, and increased polishing non-uniformity. By introducing a chemical reagent onto the polishing pad, the conditioning surface, and/or the storage apparatus of the conditioning device, accumulated glaze and slurry buildup may be significantly reduced and thus minimize the above-mentioned undesirable effects.

In embodiments of the method and system recited herein, a conditioning device including a conditioning surface may be used to condition a polishing pad. The conditioning surface may preferably contain an abrasive surface including periodic protrusions that extend partially into the polishing pad surface during conditioning. The conditioning surface may be operated to abrade the surface of the polishing pad in order to remove the buildup of slurry and glaze that may be present on the polishing pad surface. During pad conditioning, the conditioning device is positioned over the polishing pad and a downward force may be applied. The downward force is applied such that the conditioning surface may be in abrasive contact with the surface of the polishing pad. To facilitate removal of the glaze and slurry buildup, the polishing pad may be continuously rotated during the pad conditioning process. The conditioning surface may further be rotated in the same direction or in the opposite direction of the rotating polishing pad. The conditioning surface may also be swept back and forth along the polishing pad to provide lateral coverage of the polishing pad. The conditioning surface may also be moved from an outer portion of the polishing pad to an inner portion of the polishing pad to facilitate lateral coverage. To remove the abraded glaze and slurry from the polishing pad, a rinse fluid, preferably deionized water, may be continuously injected onto the polishing pad during the pad conditioning process. The fluid aids to rinse away the abraded glaze and slurry from the polishing pad surface and may be disposed of by a drain residing below the polishing pad to receive the excess of fluids and material wastes generated during the conditioning process.

In the embodiments of the method and system recited herein, the polishing pad may be conditioned with a conditioning device for a predetermined pad conditioning time interval. In one embodiment, the duration of the pad conditioning time interval may be between approximately 20 seconds and approximately 60 seconds and preferably be about 45 seconds. In other embodiments, the duration may be less than approximately 20 seconds or more than approximately 60 seconds. During the predetermined pad conditioning time interval, a chemical reagent may be introduced onto the surface of the polishing pad. The chemical reagent operates to breakup the glaze and slurry buildup and therefore aids in their removal by the abrasive force provided by the conditioning device. The chemical reagent may be introduced for a duration of approximately 20 seconds. In other embodiments, the chemical reagent may be introduced for an entirety of the predetermined pad conditioning time interval, for a duration of more than approximately 20 seconds, or for a duration of less than approximately 20 seconds.

The chemical reagent may further be introduced onto a storage apparatus of the conditioning device while the conditioning device is conditioning the polishing pad. The chemical reagent also serves to breakup any glaze and slurry buildup that may be present on the storage apparatus and therefore prevent their transfer back to the polishing pad surface upon a subsequent pad conditioning process. In addition, when the conditioning device returns to the storage apparatus upon completion of conditioning the polishing pad, the chemical reagent present in the storage apparatus may be in fluid contact with the conditioning surface and serves to breakup any glaze and slurry buildup that may have accumulated on the conditioning surface as well. In one embodiment, the chemical reagent may be introduced onto the storage apparatus concurrently with the chemical reagent being introduced onto the polishing pad during the pad conditioning time interval. The chemical reagent may be introduced onto the storage apparatus for a duration of approximately 20 seconds. Alternatively, the chemical reagent may be introduced for an entirety of the predetermined pad conditioning time interval, for a duration of more than approximately 20 seconds, or for a duration of less than approximately 20 seconds. The chemical reagent may also continue to be introduced onto the storage apparatus while the conditioning device remains at the storage apparatus. A rinse fluid, preferably deionized water, may also be flowed onto the storage apparatus to rinse away the accumulated glaze and slurry buildup on the storage apparatus and the conditioning surface. The fluid may be operated to provide a continuous flow onto the storage apparatus to provide sufficient agitation to remove the accumulated glaze and slurry buildup from the storage apparatus and the conditioning surface. The removed glaze and slurry buildup may then be disposed of by a drain residing below the storage apparatus to receive the excess of fluids and material wastes.

For embodiments in which the conditioning device is not stored onto a storage apparatus but rather suspended in storage position such that the conditioning surface is exposed to the ambient environment, the chemical reagent may be introduced onto the conditioning surface to remove the accumulated glaze and slurry buildup. A rinsing fluid may also be injected onto the conditioning surface to further remove the accumulated glaze and slurry buildup. The fluids and material wastes may then be disposed of by a drain residing below the conditioning device. In addition, the embodiments described herein in regards to sequence and duration of the chemical reagent and rinsing fluid being introduced are understood to be equally applicable to the embodiments in which a storage apparatus is not present.

In the embodiments of the method and system recited herein, a chemical reagent may be introduced to aid in the breakup of accumulated glaze and slurry buildup present on the polishing pad, the storage apparatus, and the conditioning surface. The chemical reagent may preferably be introduced onto both the polishing pad and the storage apparatus during pad conditioning. In an alternative embodiment, the chemical reagent may be introduced onto the storage apparatus during pad conditioning. Although the composition of the chemical reagent being introduced onto the polishing pad, the storage apparatus and the conditioning surface is preferably equal, in alternative embodiments the compositions may be dissimilar. For example, the composition of the chemical reagent introduced onto the polishing pad may be a stronger concentration than the composition of the chemical reagent being introduced onto the storage apparatus or conditioning surface. The chemical reagent may be selected to have a pH approximately equal to the pH of the slurry used in the CUT process. In a more particular embodiment, the pH of the chemical reagent may be between approximately 10 and 11. By way of example, in another particular embodiment, the chemical reagent may include ammonium hydroxide. Ammonium hydroxide has been experimentally observed to be effective a breaking up accumulated glaze and slurry buildup associated with CMP processes. In the particular embodiment, the ammonium hydroxide may be about 2% by volume. In alternative embodiments, the ammonium hydroxide may be greater than about 2% or less than about 2% by volume. In addition, the flow rates used to introduce the chemical reagent onto the polishing pad and storage apparatus may vary. The flow rate used to introduce the chemical reagent onto the storage apparatus may be between approximately 175 ml/min and approximately 225 ml/min. The flow rate used to introduce the chemical reagent onto the polishing pad may be between approximately 600 ml/min and approximately 700 ml/min. For larger or smaller polishing pad diameters and for longer or shorter durations of the pad conditioning time interval, the flow rates of the chemical reagent may be adjusted correspondingly.

A system for conditioning a polishing pad used in a CMP process is also contemplated. A conditioning device may be provided for conditioning the polishing pad. The conditioning device may include a conditioning surface that is operated to be in abrasive contact with the polishing pad during pad conditioning. In one embodiment, the system may include a first conduit for introducing a first chemical reagent onto the conditioning surface. In another embodiment, the system may also include a second conduit for introducing a second chemical reagent onto polishing pad. The system may also include a third conduit for introducing a rinsing fluid onto the conditioning surface. In one embodiment, the composition of the first and second chemical reagents may be equal. In one embodiment, the conduits may be fixtures external to the conditioning device. In another embodiment, the conduits may be fixtures integrated into the conditioning device.

Yet another system for conditioning a polishing pad used in a CMP process is also contemplated. A conditioning device may be provided for conditioning the polishing pad. A storage apparatus for storing the conditioning device may also be included. In one embodiment, the system may include a first conduit for introducing a first chemical reagent onto the storage apparatus. In another embodiment, the system may include a second conduit for introducing a second chemical reagent onto the polishing pad. The system may further include a third conduit for introducing a rinsing fluid onto the storage apparatus. In one embodiment, the composition of the first and second chemical reagents may be equal. In one embodiment, the conduits may be fixtures external to the conditioning device. In another embodiment, the conduits may be fixtures integrated into the conditioning device.

BRIEF DESCRIPTION OF THE DRAWINGS

Other objects and advantages of the invention will become apparent upon reading the following detailed description and upon reference to the accompanying drawings in which.

Figure 1:
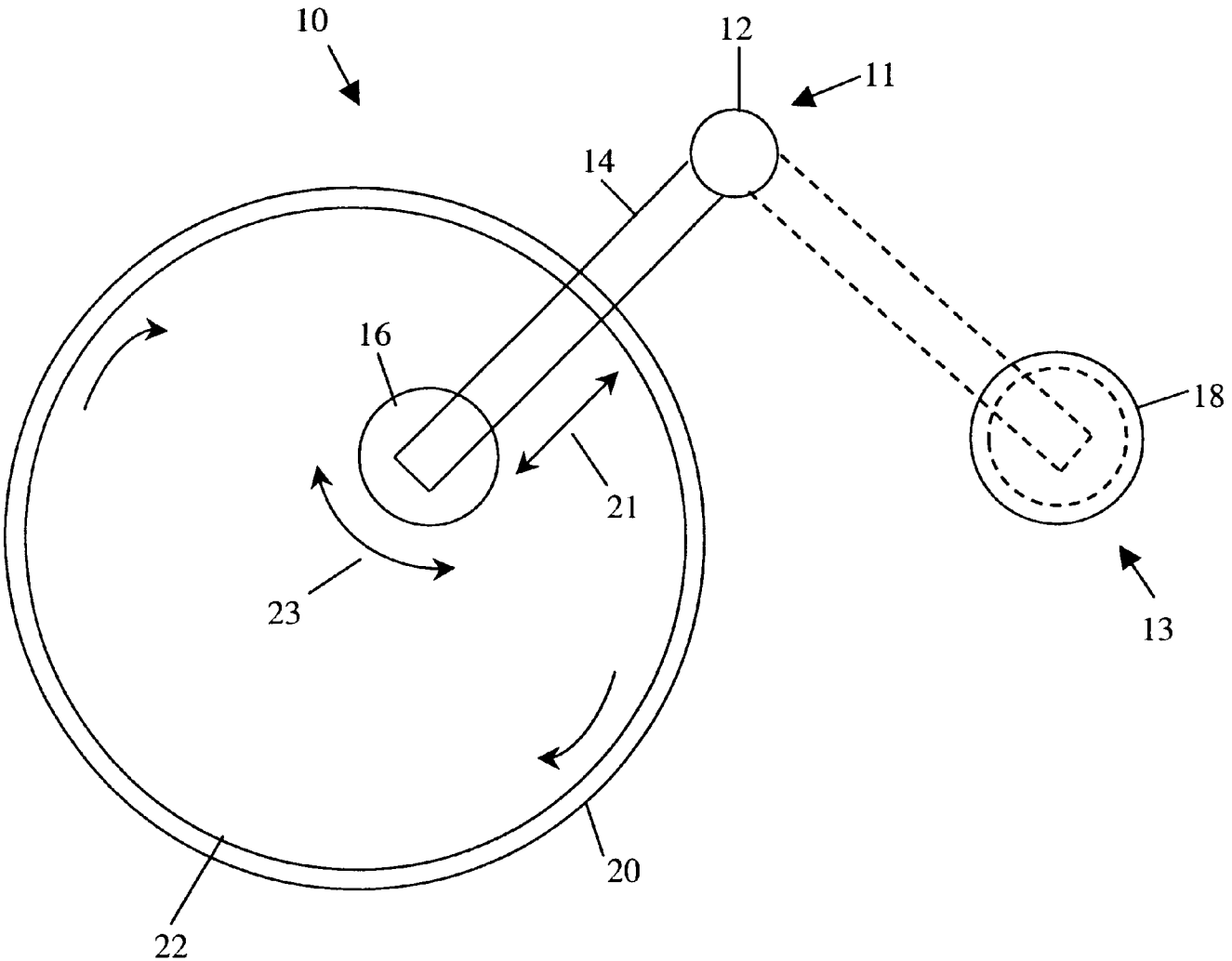
FIG. 1 is a top plan view diagram of an exemplary pad conditioning system that may be employed by embodiments of the method and system recited herein.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION OF THE PREFERRED EMBODIMENTS

Turning to the drawings, FIG. 1 is a top plan view of an exemplary pad conditioning system that may be used in a chemical-mechanical polishing system. The system may also be used to implement embodiments of the pad conditioning method and system recited herein. Pad conditioning system 10 may include platen 20 which may be operated to be rotating or placed in an orbital state. Platen 20 may be configured to rotate clockwise or counterclockwise about a fixed or moveable axis. Polishing pad 22 may be fixedly attached to platen 20 and is operated to rotate in the same direction as platen 20. Polishing pad 22 may be employed to provide mechanical abrasion for removing a material layer (s) from a substrate (not shown) during a chemical-mechanical polishing process. Pad conditioning system 10 may further include conditioning device 11. In some embodiments of the present invention, the pad conditioning process may be performed by conditioning device 11, which may be integrated into a conventional CMP system. Conditioning device 11 may include conditioning arm 14 that is disposed above polishing pad 22 and capable of pivoting about a pivoting point 12. Conditioning fixture 16 may be attached onto the end of conditioning arm 14 that is disposed above polishing pad 22. Conditioning fixture 16 includes a conditioning surface that may be operated to be in abrasive contact with polishing pad 22 during pad conditioning. In some embodiments, the conditioning surface may include an abrasive surface in order to facilitate removal of the glaze that may be present on polishing pad 22. The abrasive surface may include periodic protrusions that extend partially into the polishing pad surface during the conditioning process. Although not shown, in other embodiments conditioning device 11 may forego conditioning fixture 16 and instead may include a conditioning surface fixedly attached to the bottom of conditioning arm 14. It is to be understood that the method and system recited herein are applicable to any conditioning device 11 that may be used to perform conditioning of polishing pad 22.

For embodiments in which conditioning fixture 16 is employed, conditioning fixture 16 may be rotated in the same or opposite direction with polishing pad 22. Conditioning device 11 may also be swept back and forth, shown by arrow 23, along polishing pad 22. Conditioning device 11 may further be moved from an inner portion of polishing pad 22 to an outer portion of polishing pad 22 as shown by arrow 21.

When conditioning device 11 is not being used to condition polishing pad 22, conditioning device 11 may be positioned at storage position 13 that results in conditioning device 11 being disposed away from polishing pad 22. In one embodiment, conditioning device may be disposed at storage position 13 above storage apparatus 18. Storage apparatus 18 may include a storage vessel. Storage apparatus 18 may be configured to store the conditioning surface of conditioning device 11 and conditioning device 11 may be adapted to rotate within storage apparatus 18 while being stored. In one embodiment, storage apparatus 18 may include a fixture to store the conditioning surface. Conditioning device 11 may then remain at storage position 13 until being used for a subsequent pad conditioning process. Conditioning device 11 may alternatively be disposed at storage position 13. However, rather than employing storage apparatus 18, conditioning device 11 may be suspended at storage position 13 such that the conditioning surface may be exposed to the ambient environment.

Figure 2:
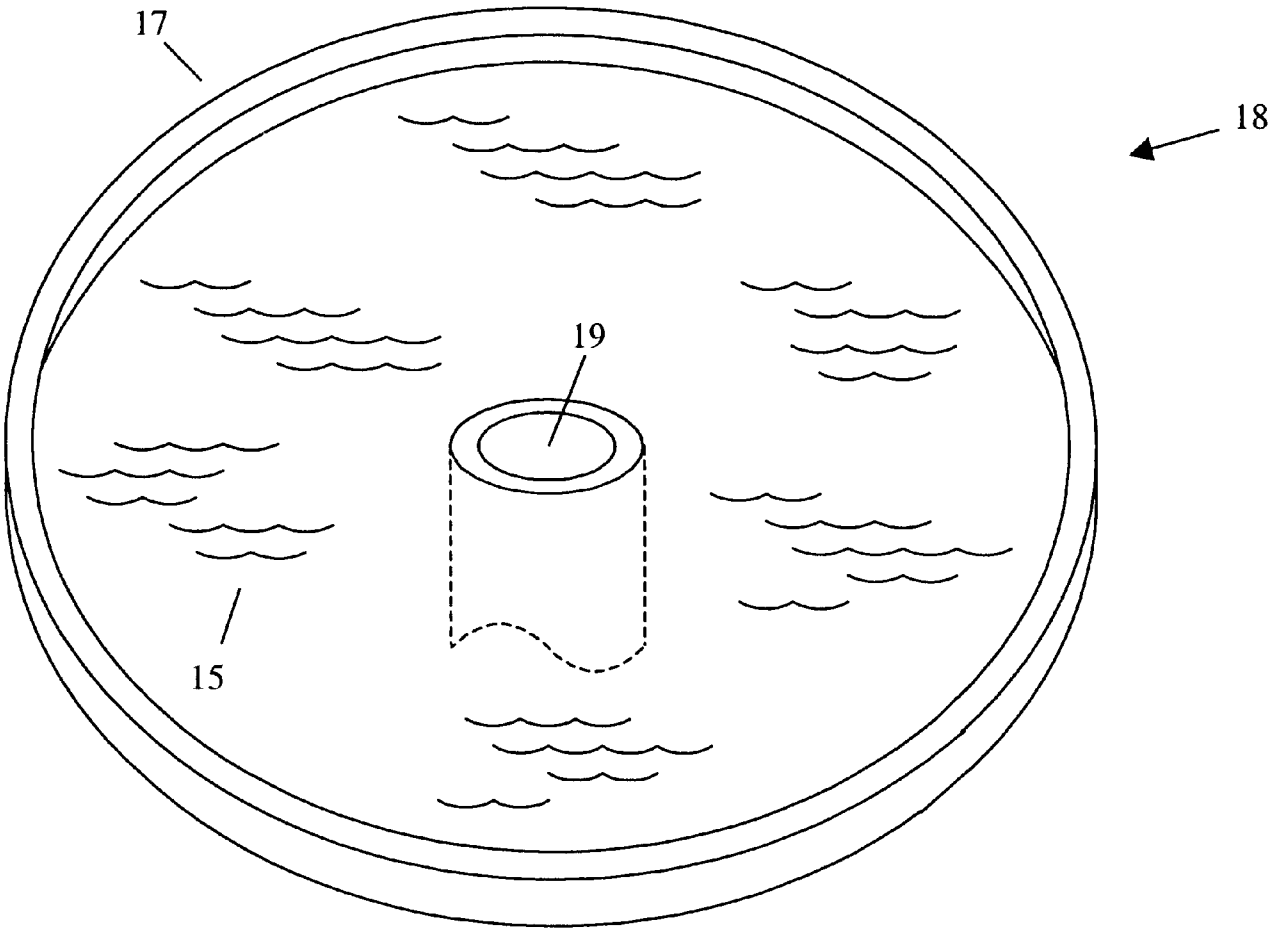
FIG. 2 is a side-elevational view of an exemplary storage apparatus used that may be employed by embodiments of the method and system recited herein.

FIG. 2 is a side-elevational view of an exemplary storage apparatus 18 that may be used in embodiments of the method and system recited herein. Storage apparatus 18 may include fixture 17 that may have a recess to hold fluid 15 inside fixture 17. Fluid 15 may be a rinsing fluid, preferably deionized water, used to rinse away any glaze and slurry buildup that may accumulate onto fixture 17. In one embodiment, fluid 15 may be introduced into fixture 17 by way of conduit 19. Fluid 15 may be introduced into fixture 17 through conduit 19 such that an overflow continuously occurs over fixture 17 to provide "new" fluid 15 into fixture 17. The "new" fluid 15 washes away the "old" fluid 15 that may include glaze and slurry buildup. Conduit 19 may also serve to attach fixture 17 to a lower surface of the chemical-mechanical polishing tool. A drain may further be located below storage apparatus 18 to remove the excess of fluid 15 and other material wastes. When conditioning device 11 is placed at storage position 13, the conditioning surface may be in constant fluid contact with fluid 15. This serves to rinse away potential glaze and slurry buildup on the conditioning surface as well as to keep the conditioning surface damp to avoid drying out any slurry buildup. Dried slurry has been observed to be one factor in the formation of microscratches during a chemical-mechanical polishing process. Residual glaze or slurry buildup on the conditioning surface may be undesirably transferred back onto polishing pad 22 during a subsequent pad conditioning process and therefore, it is desirable to remove as much glaze and slurry buildup as possible while conditioning device 11 remains at storage position 13.

Figure 3:
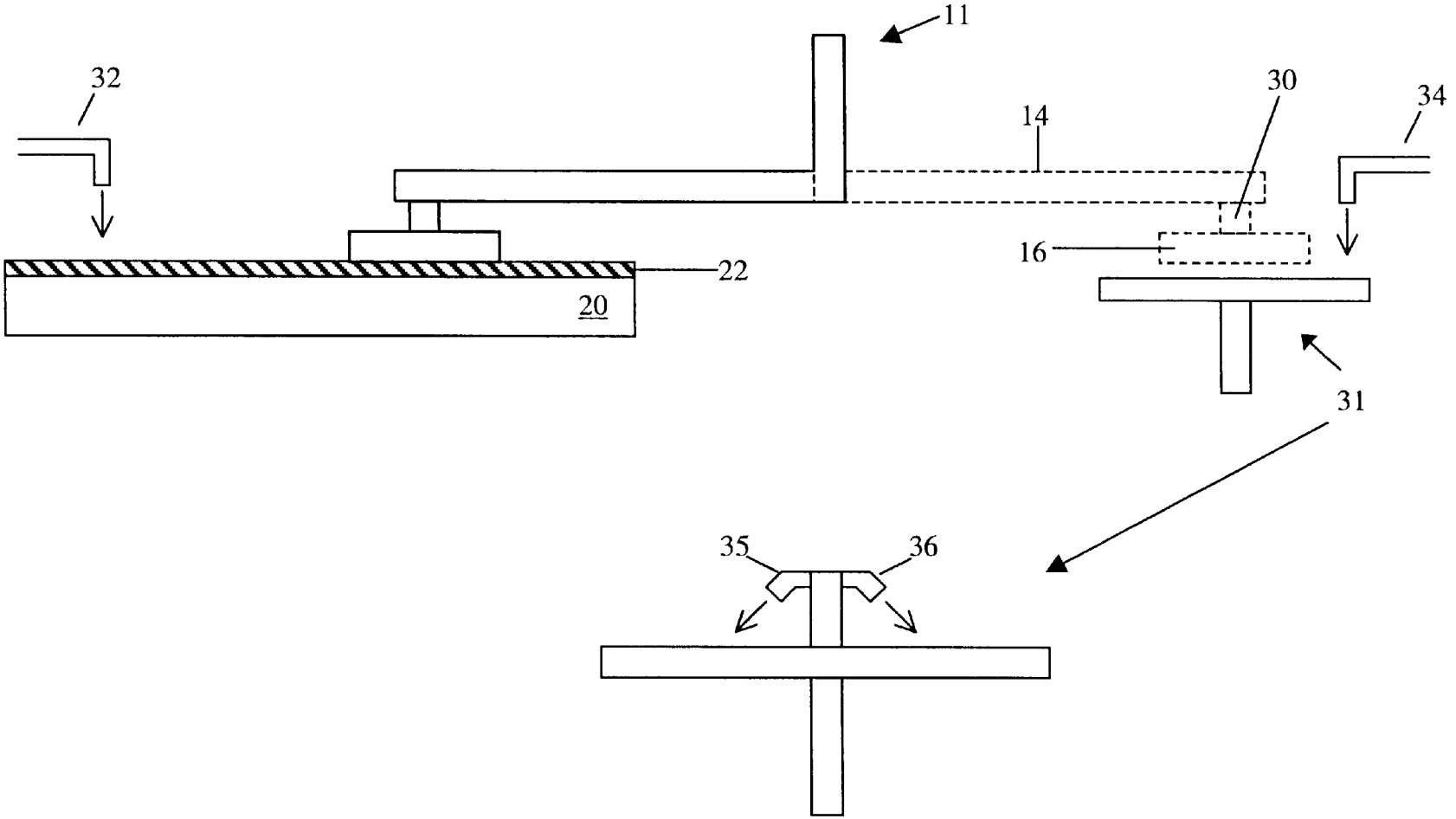
FIG. 3 is a side-view diagram of one embodiment of a pad conditioning system recited herein.

FIG. 3 is a side-view diagram illustrating embodiments of a pad conditioning system that may be employed by the method recited herein. Conduit 32 may be externally located from conditioning device 11 and be disposed above polishing pad 22 to introduce a chemical reagent onto polishing pad 22. Alternatively, conduit 32 may be integrated into conditioning device 11. Conduit 34 may also be employed to introduce the chemical reagent onto storage apparatus 31. Conduit 34 may be externally located from conditioning device 11. In an alternative embodiment, conduit 34 may be integrated into conditioning device 11. Storage apparatus 31 may also include conduits 35 and 36 to introduce a rinsing fluid onto storage apparatus 31. In embodiments in which conditioning fixture 16 may be employed, attachment 30 may be provided to attach conditioning fixture 16 to conditioning arm 14. Attachment 30 preferably allows conditioning fixture 16 to freely pivot such that conditioning fixture 16 may adapt to the surface contours of polishing pad 22 during pad conditioning.

Figure 4:
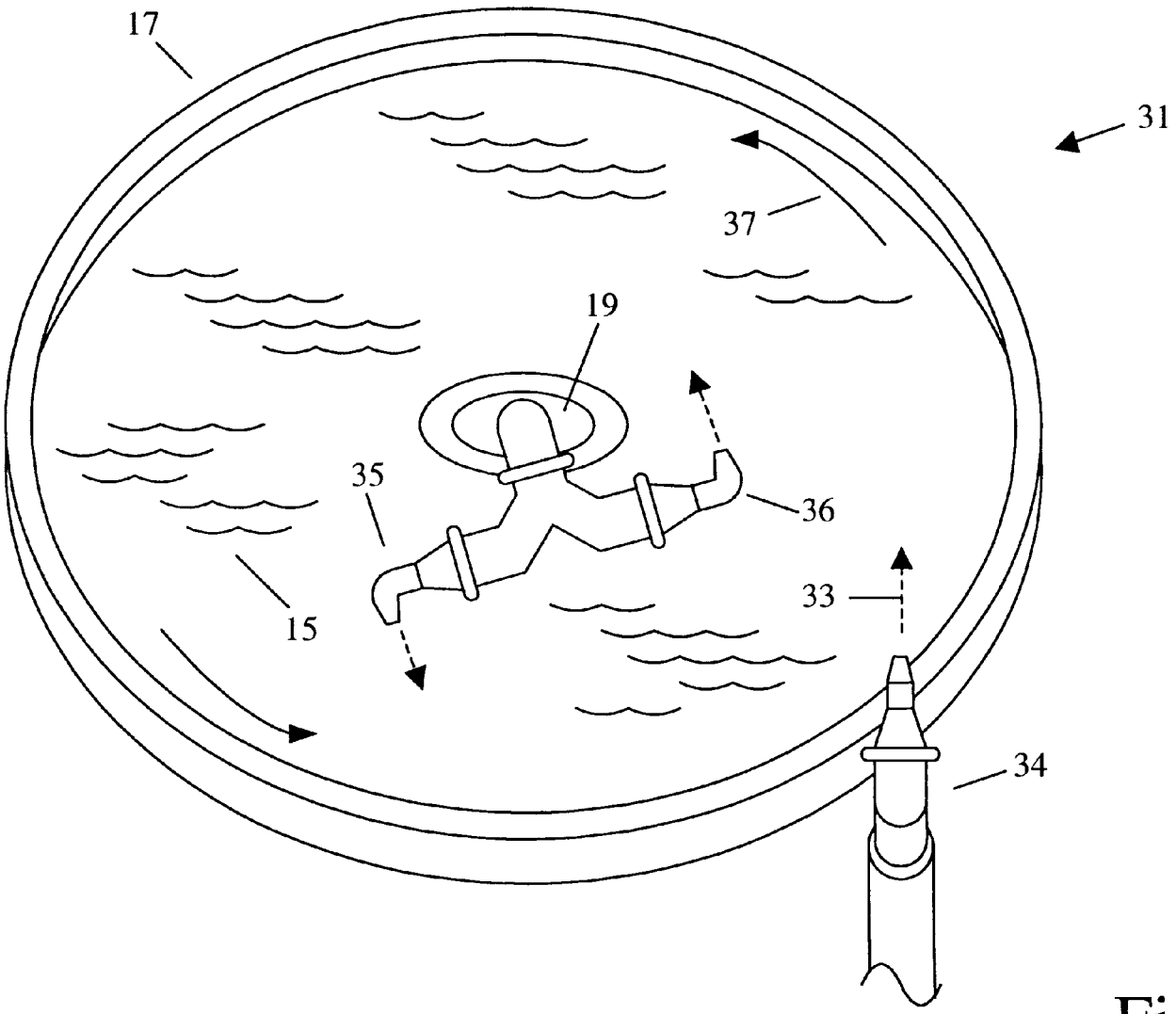
FIG. 4 is a side-elevational view of one embodiment of a storage apparatus for a pad conditioning system recited herein.

FIG. 4 is a side-elevational view showing embodiments of storage apparatus 31. Storage apparatus 31 may include fixture 17 that has a recess to hold fluids. Conduit 34 may be included to introduce the chemical reagent into storage apparatus 31 as shown by arrow 33. Alternatively, or in addition to conduit 34, conduits 35 and 36 may be employed to provide fluid 15 into fixture 17. Fluid 15 may be a rinsing fluid, preferably deionized water, to rinse away accumulated glaze and slurry buildup that may be present inside fixture 17. Conduits 35 and 36 may preferably connect to conduit 19, which is configured to provide fluid 15 into fixture 17. Conduits 35 and 36 may be operated such that a circular overflow, shown by arrow 37, continually exists when fluid 15 is introduced into fixture 17. The circular overflow preferably provides additional agitation to rinse away the glaze and slurry buildup inside fixture 17. Conduit 35 and 36 may further be rotated about an axis to create additional circular overflow. Conduits 35 and 36 may be configured external to fixture 17, similar to conduit 34, to provide fluid 15 into fixture 17. Alternatively, conduit 34 may be configured inside of fixture 17 to introduce the chemical reagent into fixture 17.

Figure 5:
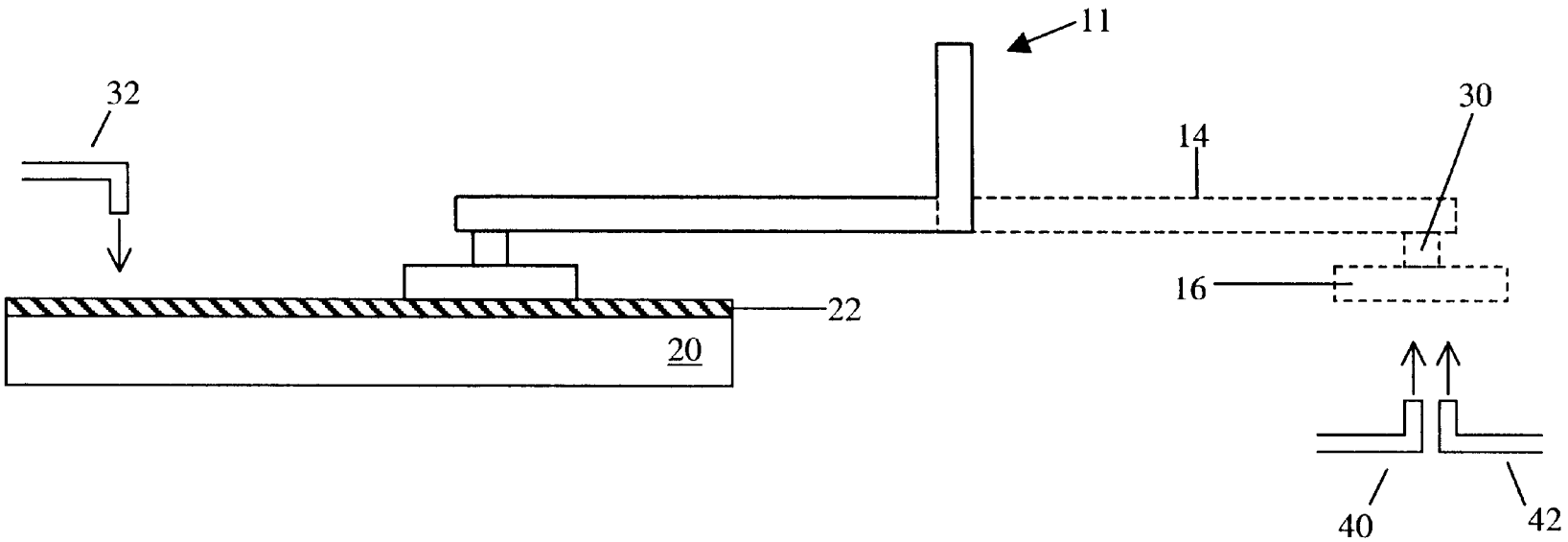
FIG. 5 is a side-view diagram of one embodiment of a pad conditioning system recited herein.

FIG. 5 is a side-view diagram showing alternative embodiments for a pad conditioning system employing the method recited herein. Conditioning device 11 may remain suspended at storage position 13 without storage apparatus 18 beneath it. Therefore, the conditioning surface of conditioning device 11 may be exposed to the ambient environment. In one embodiment, conduit 32 may be included to introduce the chemical reagent onto polishing pad 22. Conduit 32 may be external to conditioning device 11 or it may be integrated into conditioning device 11. Conduit 40 may also be included to introduce the chemical reagent onto the conditioning surface. Conduit 42 may further be included to introduce a rinsing fluid onto the conditioning surface. Conduits 40 and 42 are preferably disposed below the surface of conditioning device 11 such that the chemical reagent and rinsing fluid may be injected upwardly towards the conditioning surface. The force of the reagent and rinsing fluid is preferably suitable to remove any glaze or slurry buildup that may be present on the conditioning surface.

Polishing pad 22 may be conditioned by conditioning device 11 for a predetermined pad conditioning time interval. The duration of the predetermined pad conditioning time interval may be between approximately 20 seconds and approximately 60 seconds, and preferably be approximately 45 seconds. Alternatively, the duration may be less than approximately 20 seconds or more than approximately 60 seconds. During the predetermined pad conditioning time interval, a chemical reagent may preferably be introduced onto the surface of polishing pad 22. The chemical reagent may be introduced for a duration of approximately 20 seconds. Alternatively, the chemical reagent may be introduced for an entirety of the predetermined pad conditioning time interval, for a duration of more than approximately 20 seconds, or for a duration of less than approximately 20 seconds. The chemical reagent may also be introduced repeatedly during the predetermined pad conditioning time interval. A rinsing fluid may further be introduced onto polishing pad 22 to rinse away the glaze and slurry buildup broken down. The rinsing fluid also serves to flush out the chemical reagent from polishing pad 22 to prevent potential contamination with the chemical constituents used in the actual CMP process.

In embodiments of the system including storage apparatus 31, the chemical reagent may further be introduced onto storage apparatus 31 during the predetermined pad conditioning time interval. Preferably, the chemical reagent may be introduced onto the polishing pad concurrently with the chemical reagent being introduced onto the polishing pad during the pad conditioning time interval. The chemical reagent may be introduced onto storage apparatus 31 for a duration of approximately 20 seconds. Alternatively, the chemical reagent may be introduced for an entirety of the predetermined pad conditioning time interval, for a duration of more than approximately 20 seconds, or for a duration of less than approximately 20 seconds. The chemical reagent may also be continually introduced onto storage apparatus 31 while conditioning device 11 remains at storage apparatus 31. The chemical reagent may further be introduced repeatedly onto storage apparatus 31 while conditioning device 11 remains at storage apparatus 31. A rinsing fluid may also be introduced into storage apparatus 31 and configured to provide a continuous overflow. The rinsing fluid serves to rinse away any accumulated glaze and slurry buildup that may be present on storage apparatus 31 and the conditioning surface of conditioning device 11. Preferably, the rinsing fluid may be continuously introduced onto storage apparatus 31.

For embodiments in which the conditioning device is not stored onto a storage apparatus but rather suspended in a storage position away from the polishing pad such that the conditioning surface is exposed to the ambient environment, the chemical reagent may be injected onto the conditioning surface to remove the accumulated glaze and slurry buildup. A rinsing fluid may also be injected onto the conditioning surface to further remove the accumulated glaze and slurry buildup. The fluids and material wastes may then be disposed of by a drain residing below the conditioning device. In addition, the embodiments described herein in regards to sequence and duration of the chemical reagent being and rinsing fluid being introduced are understood to be equally applicable to the embodiments in which a storage apparatus is not present.

In the embodiments of the method and system recited herein, a chemical reagent may be introduced to aid in the breakup of accumulated glaze and slurry buildup present on the polishing pad, the storage apparatus, and the conditioning surface. The chemical reagent may preferably be introduced onto both the polishing pad and the storage apparatus during pad conditioning. Alternatively, the chemical reagent may be introduced onto the storage apparatus during pad conditioning. Although the composition of the chemical reagent being introduced onto the polishing pad, the storage apparatus and the conditioning surface is preferably equal, in alternative embodiments the compositions may be dissimilar. For example, the composition of the chemical reagent introduced onto the polishing pad may be a stronger concentration than the composition of the chemical reagent being introduced onto the storage apparatus or conditioning surface. The chemical reagent may be selected to have a pH approximately equal to the pH of the slurry used in the CMP process. In a more particular embodiment, the pH of the chemical reagent may be between approximately 10 and 11. By way of example, in another particular embodiment, the chemical reagent may include ammonium hydroxide. Ammonium hydroxide has been experimentally observed to be effective a breaking up accumulated glaze and slurry buildup associated with CMP processes. In this particular embodiment, the ammonium hydroxide may be about 2% by volume. Alternatively, the ammonium hydroxide may be greater than about 2% or less than about 2% by volume. In addition, the flow rates used to introduce the chemical reagent onto the polishing pad and storage apparatus may vary. The flow rate used to introduce the chemical reagent onto the storage apparatus may be between approximately 175 ml/min and approximately 225 ml/min. The flow rate used to introduce the chemical reagent onto the polishing pad may be between approximately 600 ml/min and approximately 700 ml/min. For larger or smaller polishing pad diameters and for longer or shorter durations of the pad conditioning time interval, the flow rates of the chemical reagent may be adjusted correspondingly.

Figure 6:
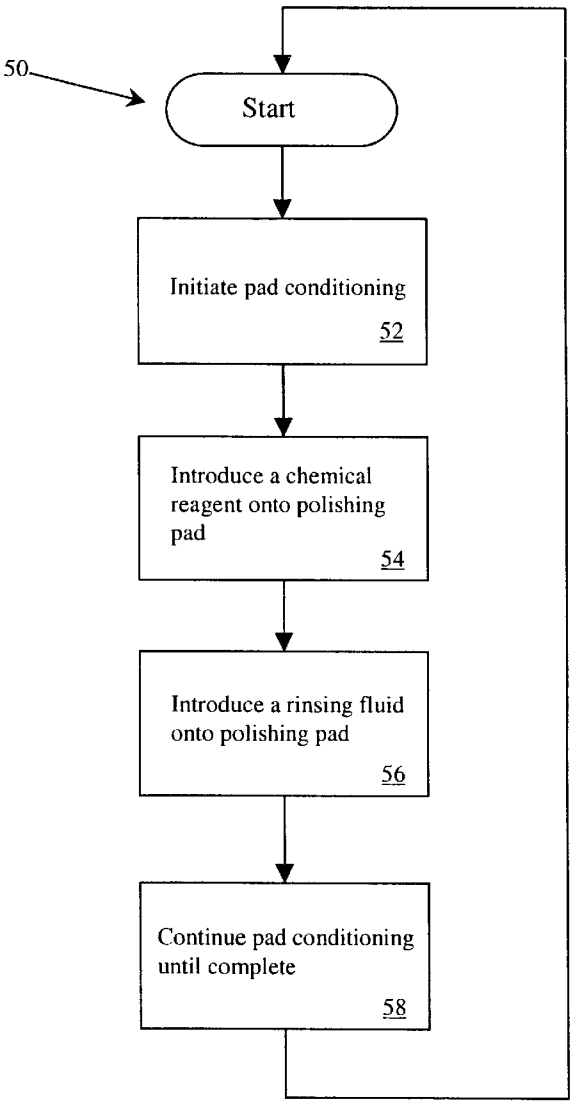
FIG. 6 is a flow diagram of one embodiment of a method for conditioning a polishing pad recited herein.

Turning now to FIG. 6, a flow diagram illustrating one embodiment of the method recited herein is presented. Pad conditioning process 50 may begin by initiating conditioning of polishing pad 22 as shown in block 52. Initiating pad conditioning may include positioning conditioning device 11 over polishing pad 22 and begin abrading of polishing pad 22. Polishing pad 22 may then be conditioned for a predetermined pad conditioning time interval. During the predetermined pad conditioning time interval, a chemical reagent may be introduced onto polishing pad 22 as shown in block 54. A rinsing fluid may also be introduced onto polishing pad 22 a shown in block 56. Pad conditioning process 50 may then continue until the process is completed as indicated by block 58. Completing the pad conditioning process may include positioning the conditioning device 11 at a storage position. Pad conditioning process 50 may then repeat upon a subsequent pad conditioning process.

Figure 7:
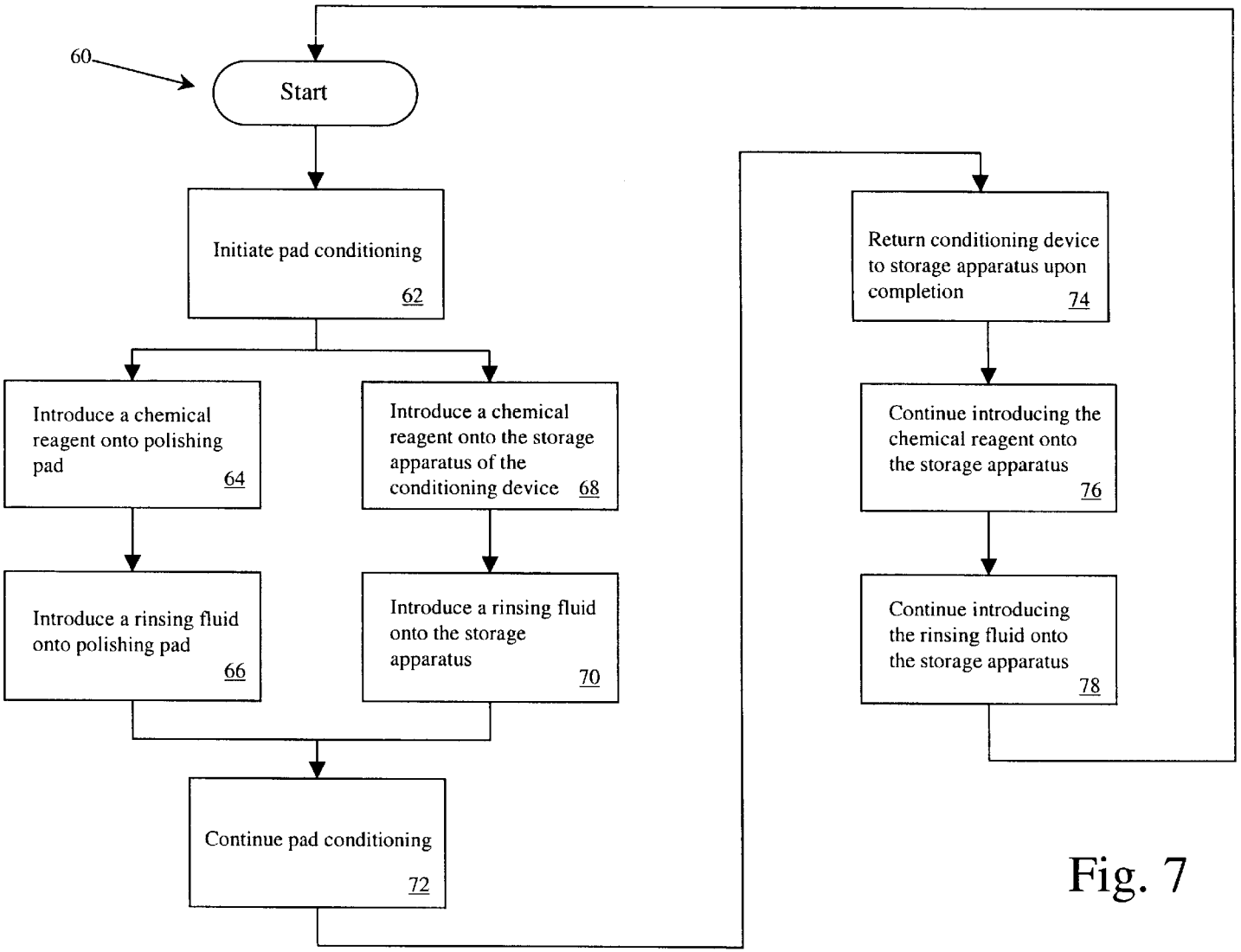
FIG. 7 is a flow diagram of one embodiment of a method for conditioning a polishing pad recited herein.

FIG. 7 is a flow diagram illustrating another embodiment of the method recited herein in which storage apparatus 31 may be used to store conditioning device 11. Pad conditioning process 60 may begin by initiating conditioning of polishing pad 22 as shown in block 62. Initiating pad conditioning may include positioning conditioning device 11 over polishing pad 22 and begin abrading polishing pad 22. Polishing pad 22 may then be conditioned for a predetermined pad conditioning time interval. During that interval, a chemical reagent may be introduced onto polishing pad 22 and storage apparatus 31 as respectively shown by blocks 64 and 68. A rinsing fluid may also be introduced onto polishing pad 22 and storage apparatus 31 as shown by blocks 66 and 70 respectively. Pad conditioning process 60 may then continue until the process is completed as indicated by block 72. Upon completion of conditioning polishing pad 22, conditioning device 11 may then be returned to storage apparatus 31 as shown in block 74. The chemical reagent may then continue to be introduced onto storage apparatus 31 as shown in block 76. Alternatively, the chemical reagent may continue to be introduced onto storage apparatus 31 for a finite time interval or repeatedly, after conditioning device 11 returns to storage apparatus 31. Block 76 may also be omitted. The rinsing fluid may also continue be introduced onto storage apparatus 31 as shown in block 78. The rinsing fluid may continuously be introduced onto storage apparatus 31 to rinse away accumulated glaze and slurry buildup as well as to prevent the slurry buildup from drying on the conditioning surface of conditioning device 11. Pad conditioning process 60 may then repeat upon a subsequent pad conditioning process.

Figure 8:
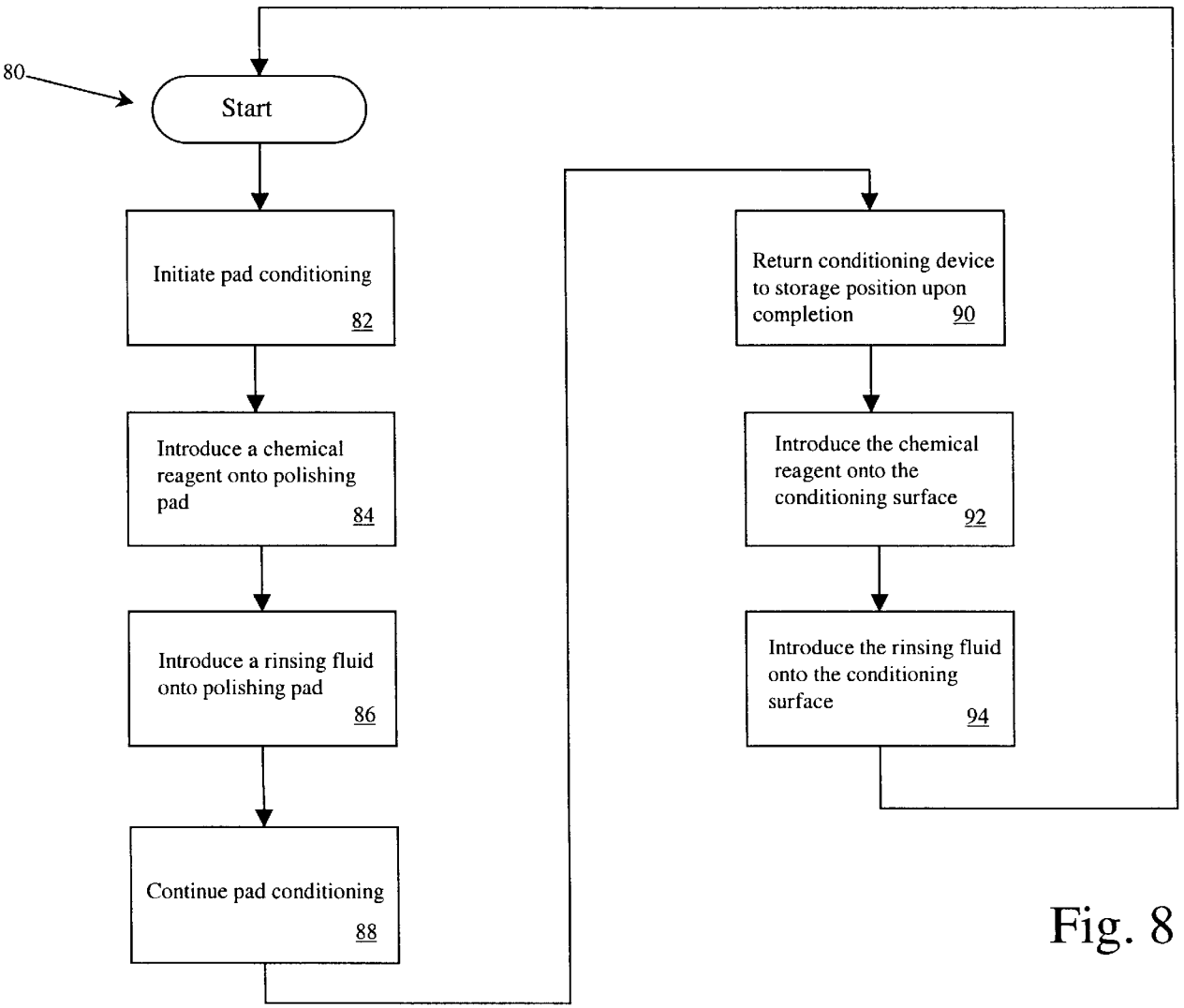
FIG. 8 is a flow diagram of one embodiment of a method for conditioning a polishing pad recited herein.

FIG. 8 is a flow diagram illustrating yet another embodiment of the method recited herein in which conditioning device 11 may be suspended at storage position 13. Pad conditioning process 80 may begin by initiating conditioning of polishing pad 22 as shown in block 82. Initiating pad conditioning may include positioning conditioning device 11 over polishing pad 22 and begin abrading polishing pad 22. Polishing pad 22 may then be conditioned for a predetermined pad conditioning time interval. During that interval, a chemical reagent may be introduced onto polishing pad 22 as shown in block 84. A rinsing fluid may also be introduced onto polishing pad 22 as shown in block 86. Pad conditioning process 80 may then continue until the process is completed as shown in block 88. Upon completion of conditioning polishing pad 22, conditioning device 11 may then be returned to storage position 13 as shown in block 90. The chemical reagent may then be introduced onto the conditioning surface of conditioning device 11 as shown by block 92. The chemical reagent may be continuously introduced onto the conditioning surface while conditioning device 11 remains at storage position 13. Alternatively, the chemical reagent may be introduced for a finite time interval or repeatedly, after conditioning device 11 returns to storage position 13. The rinsing fluid may also be introduced onto the conditioning surface as shown by block 94. The rinsing fluid may continuously be introduced onto storage apparatus 31 to rinse away accumulated glaze and slurry buildup as well as to prevent the slurry buildup from drying on the conditioning surface of conditioning device 11. Pad conditioning process 80 may then repeat upon a subsequent pad conditioning process.

It is to be understood that at the point in which embodiments of the method recited herein are begun, chemical-mechanical polishing of a substrate may have completed or may be undergoing the polishing process. It is also understood that in the embodiments of the method recited herein above, a plurality of modifications to the sequence of the steps may be possible. The steps may be carried out in any order or repeated numerous times in any order. The steps may also be performed concurrently or simultaneously if so desired. For example, in FIG. 6, step 56 may occur before step 54. In another example, steps 54 and 56 may occur before step 52. In yet another example, step 94 may occur before step 92 (in FIG. 8). In yet still another example, steps 64 and 68 may occur before step 62 (in FIG. 7). Accordingly, by way of these examples, one skilled in the art may modify the methods recited herein in various methodologies upon having knowledge of the present invention.

It will be appreciated by those skilled in the art having the benefit of this disclosure that this invention is believed to provide a method and system for conditioning a polishing pad used in a chemical-mechanical polishing process. Pad conditioning by the method and system recited herein may result in optimum chemical-mechanical polishing results. This may be attributed to the reduction in accumulated glaze and slurry buildup on the polishing pad, on the conditioning surface of the conditioning device, and on the storage apparatus used to store the conditioning device. A reduction in accumulated glaze and slurry buildup may result in a lower defect chemical-mechanical polishing process. It may also minimize the reduction of polishing rate and polishing non-uniformity. Optimum process results that may arise from employment of the method and system recited herein may then translate to significantly lower process-induced defects and potentially lower yield-limiting defects. Reduction in yield limiting defects may then result in substantially higher die yields. Furthermore, it is also to be understood that the form of the invention shown and described above is to be taken as exemplary, presently preferred embodiments. Various modifications and changes may be made without departing from the spirit and scope of the invention as set forth in the claims. It is intended that the following claims be interpreted to embrace all such modifications and changes.

What is claimed is:

1. A system for conditioning a polishing pad in a chemical-mechanical polishing process, comprising:

a conditioning device for conditioning the polishing pad during a first time;

a storage vessel into which the conditioning device can be at least partially inserted during a second time;

a first reagent source introducing a first reagent into the storage vessel; and a rinsing agent source introducing a rinsing fluid into the storage vessel, wherein the first reagent is different than the rinsing fluid.

2. The system recited in claim 1, further comprising a second reagent source for introducing a second reagent onto the polishing pad.

3. The system recited in claim 2, wherein the composition of the first reagent and the composition of the second reagent are equal.

4. The system recited in claim 2, wherein the composition of the first reagent and the composition of the second reagent are different.

5. The system recited in claim 1, wherein the first reagent has a pH approximately equal to a pH of a slurry deposited on the polishing pad during the chemical-mechanical polishing process.

6. The system recited in claim 1, wherein the first reagent has a pH between approximately 10 and approximately 11.

7. The system recited in claim 1, wherein the first reagent comprises ammonium hydroxide.

8. The system recited in claim 1, wherein the first reagent comprises approximately 2% ammonium hydroxide by volume.

9. The system recited in claim 1, wherein the conditioning device is adapted to rotate within the storage vessel.

10. The system recited in claim 1, further comprising a rinsing fluid source wherein the introduction of the rinsing fluid creates a circular flow of the rinsing fluid in the storage vessel.

11. The system recited in claim 1, wherein the first reagent is introduced into the storage vessel during the first time and during the second time.

12. A system for conditioning a polishing pad in a chemical-mechanical polishing process, comprising:

a conditioning device for conditioning the polishing pad, wherein the conditioning device comprising a conditioning device for conditioning the polishing pad, wherein the conditioning device comprises a conditioning surface operated to be in abrasive contact with the polishing pad during said conditioning;

a first reagent source introducing a first reagent onto the conditioning surface; and a rinsing agent source introducing a rinsing fluid onto the conditioning surface, wherein the first reagent is different than the rinsing fluid.

13. The system recited in claim 12, further comprising a second reagent source introducing a second reagent onto the polishing pad.

14. The system recited in claim 13, wherein the composition of the first reagent and the composition of the second reagent are equal.

15. The system recited in claim 12, wherein the first reagent has a pH approximately equal to a pH of a slurry deposited on the polishing pad during the chemical-mechanical polishing process.

16. The system recited in claim 12, wherein the first reagent has a pH between approximately 10 and approximately 11.

17. The system recited in claim 13, wherein the composition of the first reagent and the composition of the second reagent are different.

18. The system recited in claim 12, wherein the first reagent comprises ammonium hydroxide.

19. The system recited in claim 12, wherein the first reagent comprises approximately 2% ammonium hydroxide by volume.

20. The system recited in claim 12, wherein the first conduit introduces the first reagent onto the conditioning surface after said conditioning, and wherein the rinsing fluid is introduced onto the conditioning surface after said conditioning.

* * * * *